United States Patent [19]

Wernigg et al.

[11] Patent Number: 4,758,049

[45] Date of Patent: Jul. 19, 1988

[54] APPARATUS FOR THE UNDERGROUND OPERATION OF A MOVABLE MINING MACHINE

[75] Inventors: Gerhard Wernigg, Mühlen; Helmut Trapp, Stainbach, both of Austria

[73] Assignee: Voest-Alpine Aktiengesellschaft, Linz, Austria

[21] Appl. No.: 905,266

[22] Filed: Sep. 9, 1986

[30] Foreign Application Priority Data

Sep. 12, 1985 [AT] Austria ..... 2674/85
Jul. 7, 1986 [AT] Austria ..... 1833/86

[51] Int. Cl.[4] ..... E21C 27/24; E01C 23/12

[52] U.S. Cl. ..... 299/33; 299/64; 404/91

[58] Field of Search ..... 299/33, 11, 18, 64, 299/7, 8; 401/91

[56] References Cited

U.S. PATENT DOCUMENTS

| | | | |
|---|---|---|---|
| 3,016,204 | 1/1962 | Lung | 241/200 |
| 3,268,258 | 8/1966 | Kegel | 299/64 |
| 3,939,958 | 2/1976 | Pyles | 299/11 X |
| 3,995,905 | 12/1976 | Jamison | 299/33 X |
| 4,068,893 | 1/1978 | Weirich | 299/12 X |
| 4,173,373 | 11/1979 | Campbell et al. | 299/18 X |
| 4,310,197 | 1/1982 | McCracken et al. | 299/33 X |
| 4,418,872 | 12/1983 | Nelson | 241/101.7 X |
| 4,662,685 | 5/1987 | Barnthaler et al. | 299/33 |
| 4,676,688 | 6/1987 | Caradot | 404/91 |

FOREIGN PATENT DOCUMENTS

| | | |
|---|---|---|
| 2727020 | 12/1977 | Fed. Rep. of Germany . |
| 2702006 | 7/1978 | Fed. Rep. of Germany . |
| 2756789 | 7/1978 | Fed. Rep. of Germany . |

*Primary Examiner*—Stephen J. Novosad
*Assistant Examiner*—Terry Lee Melius
*Attorney, Agent, or Firm*—Cushamn, Darby & Cushman

[57] ABSTRACT

In a mining machine (1) designed for underground operation, for example for cutting coal seams, and being equipped with a removal conveyor means taking up the heap of debris in front of the mine face and transferring this heap of debris to a removal conveyor plant (18) arranged behind the mining machine (1), there is interpositioned, separately from the mining machine, between the mining machine (1) and the removal conveyor plant (18) a crushing aggregate (2) comprising its own travel drive and being movable on a chassis in particular being equipped it caterpillars (27). The crushing aggregate (2) comprises a receiving chute (11) provided on a frame (25), a conveyor (12) starting from this receiving chute and extending with its discharge end beyond said frame and at least one crusher roll (13) within the area between the receiving chute (11) and the discharge end (15) of the conveyor (12). At least one device for boring anchor holes and placing anchors in position is arranged on the frame (25) within the area of its front portion located adjacent the mining machine for being displaceable in advancing direction and in transverse direction thereto. On account of the crushing aggregate (2) being arranged separately from the mining machine (1), the mining machine (1) can be moved while the crushing aggregate (2) remains on one and the same place. The crushing aggregate (2) is then stepwisely moved in direction to the mining machine (1).

14 Claims, 6 Drawing Sheets

APPARATUS FOR THE UNDERGROUND OPERATION OF A MOVABLE MINING MACHINE

BACKGROUND OF THE INVENTION

1. Field of the Invention

The invention refers to an apparatus for the underground operation of a movable mining machine being equipped with a removal conveyor means taking up the heap of debris in front of the mine face and transferring the heap of debris to a removable conveyor plant arranged behind the mining machine, noting that a movable crushing aggregate is provided, as seen in direction of travel, behind the mining machine.

2. Description of the Prior Art

In a continuous mining process, such as, for example for recovering pit coal, the heap of debris is most frequently directly transferred to the subsequent removal conveyor plant by the removal conveyor means of the mining machine. This removal conveyor plant consists, as a rule, of movable conveyors equipped with conveyor belts or chains. The removal conveyor means of the mining machine takes up the heap of debris in front of the mine face, and in this heap of debris there are present also big blocks which are then transferred to the removal conveyor plant without special treatment. Further transport of such big blocks is, however, unfavourable and frequently results in difficulties or jamming, respectively.

From DE-OS No. 27 27 020 and DE-OS No. 27 56 789 it has become known to arrange in combination with a mining machine, being movable on a conveyor means, a light crushing aggregate, equally being movable on the conveyor means, within the area of the rear end of the mining machine, the crushing aggregate being rigidly coupled to the mining machine or even being arranged on the frame of the mining machine.

Such a light crushing aggregate is not suitable for crushing big and heavy blocks. For the purpose of crushing big and heavy blocks, a heavy crushing aggregate is necessary which must be supported against the floor in a stabile manner. If such a crushing aggregate is rigidly coupled to the mining machine, this crushing aggregate obstructs the advancing movement of the mining machine and makes impossible the continuous operation of the mining machine.

In case of a fragile drift roof it is necessary to place anchors behind the mining machine for preventing collapsing of the mine roof. For this purpose, it is common practice to arrange a device for boring anchor holes and for placing anchors in position on a separate carriage which is moved within the area behind the mining machine and is used for boring the anchor holes and for placing the roof anchors in position. The use of such anchor hole boring and anchor placing carriages requires to keep free the area behind the mining machine which, however, again obstructs the continuous removal of the heap of debris cut by the mining machine. Also this condition prevents continuous operation of the mining machine.

SUMMARY OF THE INVENTION

It is an object of the invention to provide for a continuous operation of the mining machine. For solving this task, the invention essentially consists in that the crushing aggregate is arranged between the mining machine and the subsequent removal conveyor plant on a chassis comprising its individual travel drive and in particular being equipped with caterpillars and is separated from the mining machine, in that the chassis has a frame on which is arranged a receiving chute, a conveyor starting from this receiving chute and extending with its discharge end beyond the frame and at least one crushing roll within the area between the receiving chute and the discharge end of the conveyor and in that at least one device for boring anchor holes and placing anchors is arranged within the area of the front portion, located adjacent the mining machine, of the frame for being displaceable in advancing direction and in transverse direction thereto. On account of the discharge end of the conveyor of the crushing aggregate extending beyond the rear end of the frame, the heap of debris, having already been made approximately uniform in size, can be discharged into the receiving chute of the subsequent conveyor of the removal conveyor plant. On account of the chassis of the crushing aggregate being separated from the mining machine and being equipped with its own travel drive, the mining machine can continuously be moved independent from the crushing aggregate, while the chassis, and therewith the crushing aggregate, temporarily remains on one and the same place and is stepwisely moved in direction to the mining machine. The crushing aggregate can thus be operated if the chassis is stationary, so that the crushing aggregate can be supported in a stabile manner and its support means can be spared even if big and heavy blocks are crushed. On account of the device for boring anchor holes and for placing anchors also being arranged on the frame of the crushing aggregate, this device for boring anchor holes and placing anchors in position can be operated within periods during which the chassis is at rest. On account of this device for boring anchor holes and placing anchors in position being arranged within the front portion, located adjacent the mining machine, of the frame, the anchors can be placed in position in proximity of the mining machine, so that the mine roof can be consolidated already within the area behind the mining machine. On account of this device for boring anchor holes and placing anchors in position being displaceable in drift advancing direction and in transverse direction thereto, the anchors can be placed in position at any desired location of the mine roof. All these measures provide, in combination, for a continuous operation of the mining machine and a continuous removal of the heap of debris from the mining machine.

According to the invention, the device for boring anchor holes and placing anchors in position may be arranged for being swivellable around a vertical axis on a swivel arm pivotally supported on the frame. Within the area of the swivel support of the swivel arm carrying the device for boring anchor holes and placing anchors in position there can, according to the invention, be arranged on the frame an operator's stand for an operator, so that the operator can observe correct positioning of the anchor. This device for boring anchor holes and for positioning anchors may be arranged on the swivel arm in front of the front end of the frame of the crushing aggregate, said swivel arm being swivellably supported for being horizontally swivellable around an approximately vertical axis arranged laterally of the conveyor arranged on the frame and in front of the crusher roll. If the swivel arm is given a corresponding length, it is possible to cover the whole width of the mine roof by one single device for boring anchor holes and positioning anchors, noting that the swivel arm may be length-adjustable by means of a piston-cylinder-aggregate. According to a preferred embodiment of the invention, there is, however, arranged on both sides of the conveyor arranged on the frame of the chassis one device for boring anchor holes and placing anchors in position on one swivel arm each. In this manner it becomes possible to simultaneously position anchors at both sides of the mine roof and this results in the advantage that there are reduced down to one half those periods which are required for keeping stationary the chassis of the crushing aggregate when anchors are to be placed in position, and this is favourable for the continuous operation of the mining machine. In this case and according to the invention, it is convenient to arrange at both sides of the frame one operator's stand for one operator. These both operators are thus in the position to observe from close proximity the operation of the device for boring anchor holes and for placing anchors in position and these operators are fully occupied because they must place into the device for positioning anchors a new anchor after having made the anchor hole. The stopping periods of the chassis are thus still further reduced. In this case, it is convenient to arrange the devices for boring anchor holes and positioning anchors behind, as seen in drift advancing direction, the receiving chute arranged on the frame. The receiving chute has a greater width than the conveyor arranged on the frame and, on account of the devices for boring anchor holes and positioning anchors being arranged at both sides and the associated operator's stands being arranged behind the receiving chute, the space behind the receiving chute is utilized for accommodating the devices for boring anchor holes and positioning anchors and for the operator's stands without substantially exceeding the width of the chassis. With such a device for boring anchor holes and positioning anchors it is possible to position anchors having a length of up to 1.5 m. Such a length becomes possible because the device for boring anchor holes and positioning anchors is arranged in front of the front end of the frame and because the space in front of the front end of the frame is free. It is only the discharge end of the conveyor of the mining machine which extends into said space, and said discharge end may, according to the invention, be laterally swivellable for clearing this space for the device for boring anchor holes and positioning anchors.

According to the invention the arrangement is preferably such that the frame of the crushing aggregate is connected with the chassis for being swivellable around a transverse axis arranged behind the longitudinal center of the frame and is swivellable in upward direction by a lifting mechanism being, in particular, formed of piston-cylinder-aggregates. In this manner, the receiving chute of the conveyor of the crushing aggregate can be brought into a position which is favourable for receiving the heap of debris discharged by the conveyor of the mining machine, on the one hand, and, on the other hand, also the crushing aggregate can be made stationary during its operation. On advancing the crushing aggregate, the frame is then lifted off the floor by means of the lifting mechanism. Conveniently and according to the invention, the length of the chute of the crushing aggregate corresponds to at least the magnitude of one advancing step of the mining machine. In this manner, the crushing aggregate can remain on one and the same place and the heap of debris enters the chute while the mining machine performs its advancing movement which is necessary for introducing the cutting heads into the mine face and cutting the rows following next.

According to a preferred embodiment of the invention, the conveyor of the crushing aggregate is an armor chain conveyor, above which the crushing roll is arranged with its axis extending in horizontal direction and in transverse direction to the longitudinal direction of the armor chain conveyor. The crusher gap is thus defined by the armor chain conveyor and the crusher roll and such an armor chain conveyor can easily resist the force exerted by the crusher roll. In this case, the crusher can be a roll beater crusher. Spray nozzles for water may, according to the invention, be arranged in front of and/or behind the crusher roll, which results in reducing or avoiding dust generation.

According to the invention, the arrangement is conveniently such that at least that portion of the removal conveyor plant, which is located adjacent the crushing aggregate, is formed of movable conveyors, of which the foremost is coupled with or can be coupled to the crushing aggregate. In this manner, the travel drive of the chassis of the crushing aggregate can be utilized for the advancing movement of the subsequent removal conveyor plant.

BRIEF DESCRIPTION OF THE DRAWING

In the drawing, the invention is schematically illustrated by an embodiment.

FIG. 4 shows a top plan view and FIG. 5 shows a view of the crushing aggregate in direction of the arrow V of FIG. 4.

DETAILED DESCRIPTION OF THE PREFERRED EMBODIMENT

Figures 1, 2:
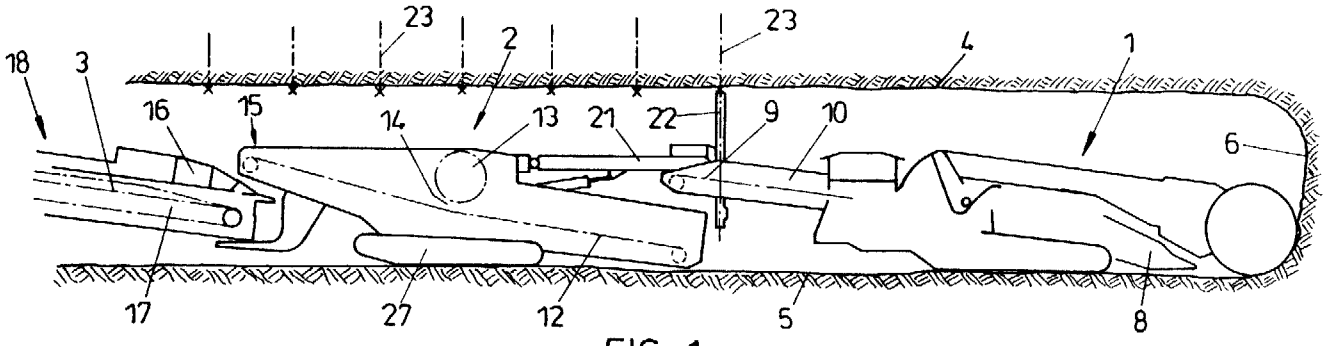
FIGS. 1 and 2 show the arrangement of the mining machine of the crushing aggregate and of the front portion of the subsequent removal conveyor plant within the mine, FIG. 1 showing a side elevation and FIG. 2 showing a top plan view.

In FIGS. 1 and 2, reference numeral 1 designates the mining machine, reference numeral 2 designates the crushing aggregate and reference numeral 3 designates the first subsequent conveyor of the removal conveyor plant. Reference numeral 4 designates the mine roof, reference numeral 5 designates the mine floor, reference numeral 6 designates the mine face and reference numeral 7 designates the side wall of the drift.

In front of the mining machine there is arranged a loading ramp 8 which represents the front portion of the removal conveyor means of the mining machine 1. Reference numeral 9 designates the discharge end of the rear portion of the conveyor means 10 of the mining machine 1. From this discharge end 9, the heap of debris enters the receiving chute 11 of the crushing aggregate 2. The heap of debris is fed to a crusher roll 13 via an armor chain conveyor 12 , in which the heap of debris is shifted over the armor plates by rods 12' by means of chains and the heap of debris is crushed within the gap 14 between the crusher roll 13 and the armor chain conveyor 12. At the discharge end 15 of the armor chain conveyor 12, the crushed heap of debris is thrown into the receiving chute 16 of the first conveyor 17 of the removal conveyor plant 18.

The mine drift is designated by reference numeral 19. The line 20 indicates the limiting wall of the second excavation made with the mining machine 1 laterally shifted.

A device 22 for boring anchor holes and placing anchors in position is arranged on a horizontally swivellable swivel arm 21 and designed for placing anchors in position which are indicated by dash-dotted lines 23. The rear portion of the conveyor means 10 of the mining machine 1 is laterally swivellable around an axis 24 for the purpose of clearing the space for the device 22 for boring anchor holes and applying anchors.

Figure 3:
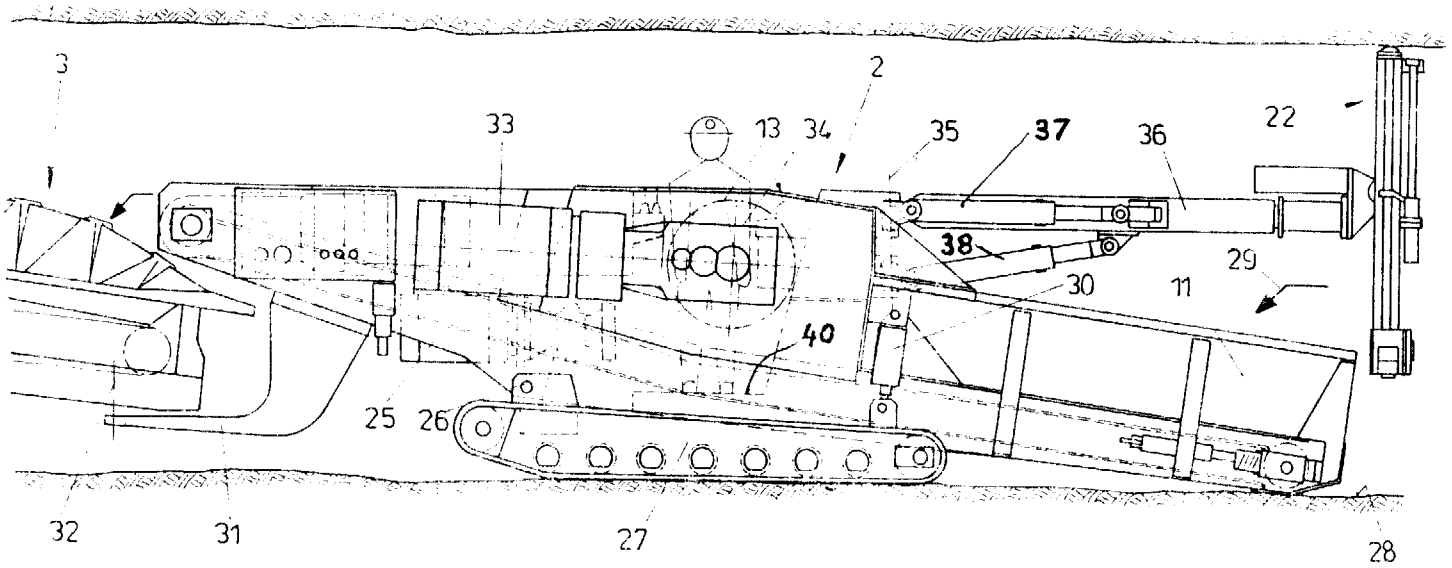
FIGS. 3, 4 and 5 show the crushing aggregate, noting that FIG. 3 shows a side elevation.
Figure 4:
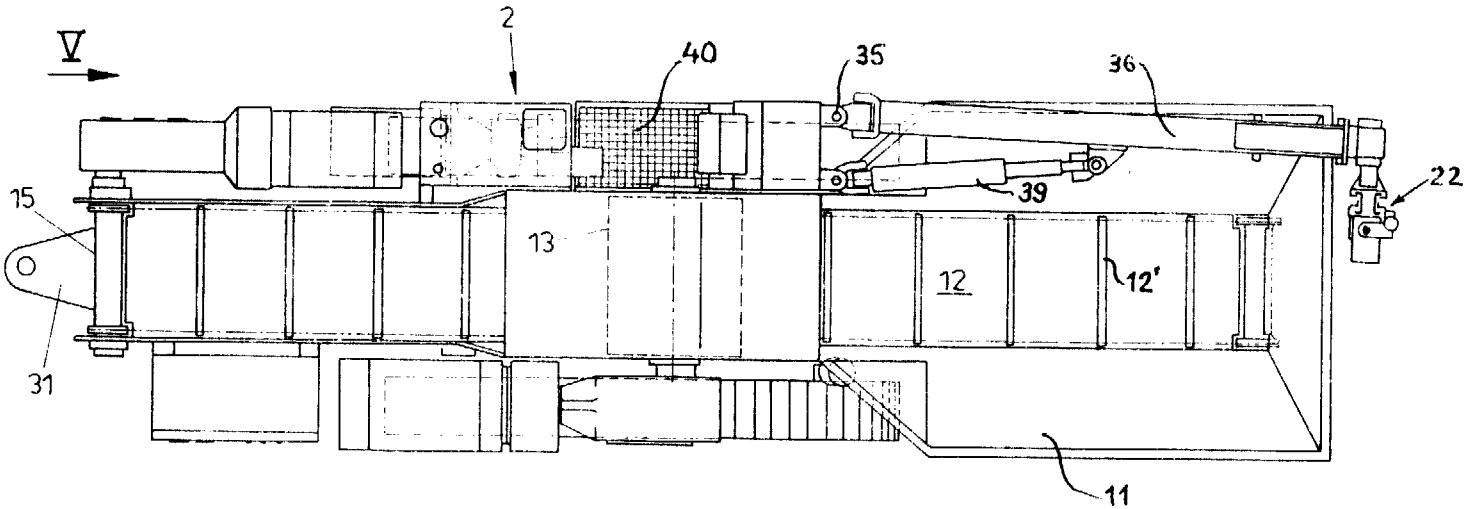
Figure 5:
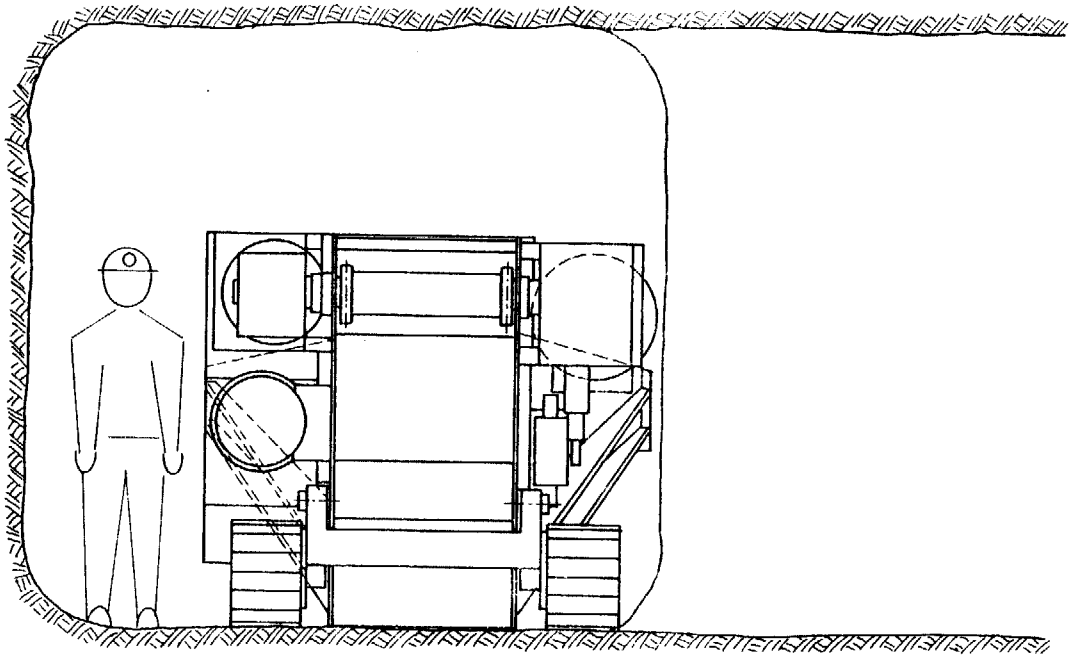

As can be seen in FIGS. 3, 4 and 5, the crushing aggregate 2 has a frame 25 which is swivellably supported for swivelling movement around a horizontal transverse axis 26 on the chassis or the caterpillar chassis 27, respectively. The frame 25 is shown in its lowered position in which the receiving chute 11 of the crushing aggregate is rested on the mine floor 28. In this position, the crushing aggregate is secured in its position and the heap of debris can, as is indicated by an arrow 29, be thrown into the receiving chute 11. The frame 25 can be upwardly swivelled by means of two cylinder-piston-aggregates 30, so that the crushing aggregate can be moved to an other site. The first conveyor 3 of the subsequent removal conveyor plant 18 is coupled to the crushing aggregate 2 for being swivellably around an axis 32 by means of a claw 31 arranged on the frame 25. The armor chain conveyor 12 runs below the crusher roll 13 and the heap of debris is being crushed between the armor chain conveyor 12 and the crusher roll 13. At the discharge end 15, the crushed heap of debris is thrown into the receiving chute 16 of the subsequent conveyor 3. Reference numeral 33 designates the drive motor and reference numeral 34 designates the gearing for the crusher roll 13.

At the end of a swivellable swivel arm 36, which is swivellable around a vertical axis 35, there is arranged the device 22 for boring anchor holes and positioning anchors, by means of which device the anchors 23 can be positioned if this device assumes the position according to FIG. 3, in which the frame 25 of the crushing aggregate 2 is supported on the mine floor 28 and is thus made stationary. The swivel arm 36 can be lengthened or shortened by means of the piston-cylinder-aggregate 37, can be lifted and lowered by means of the piston-cylinder aggregate 38 and can laterally be swivelled by means of a piston-cylinder-aggregate, so that the device 22 for boring anchor holes and positioning anchors can be brought to all locations of the mine roof 4.

Reference numeral 40 designates an operator's stand, arranged on the frame 25, for an operator.

Figure 6:
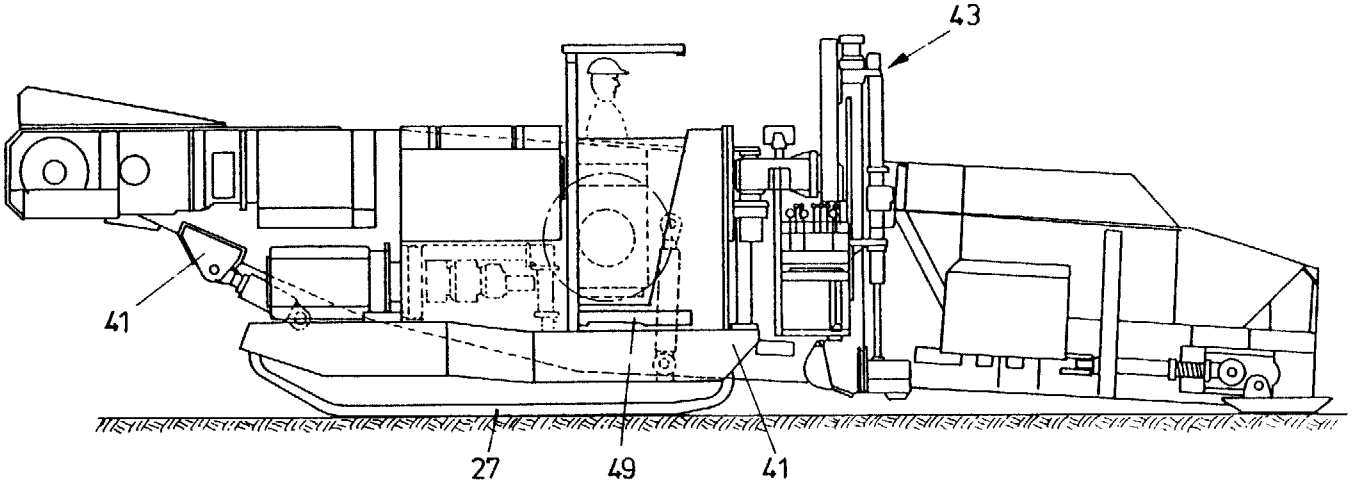
FIGS. 6 and 7 show a modified embodiment of the chassis together with the crushing aggregate in a side elevation and in a top plan view, respectively.
Figure 7:
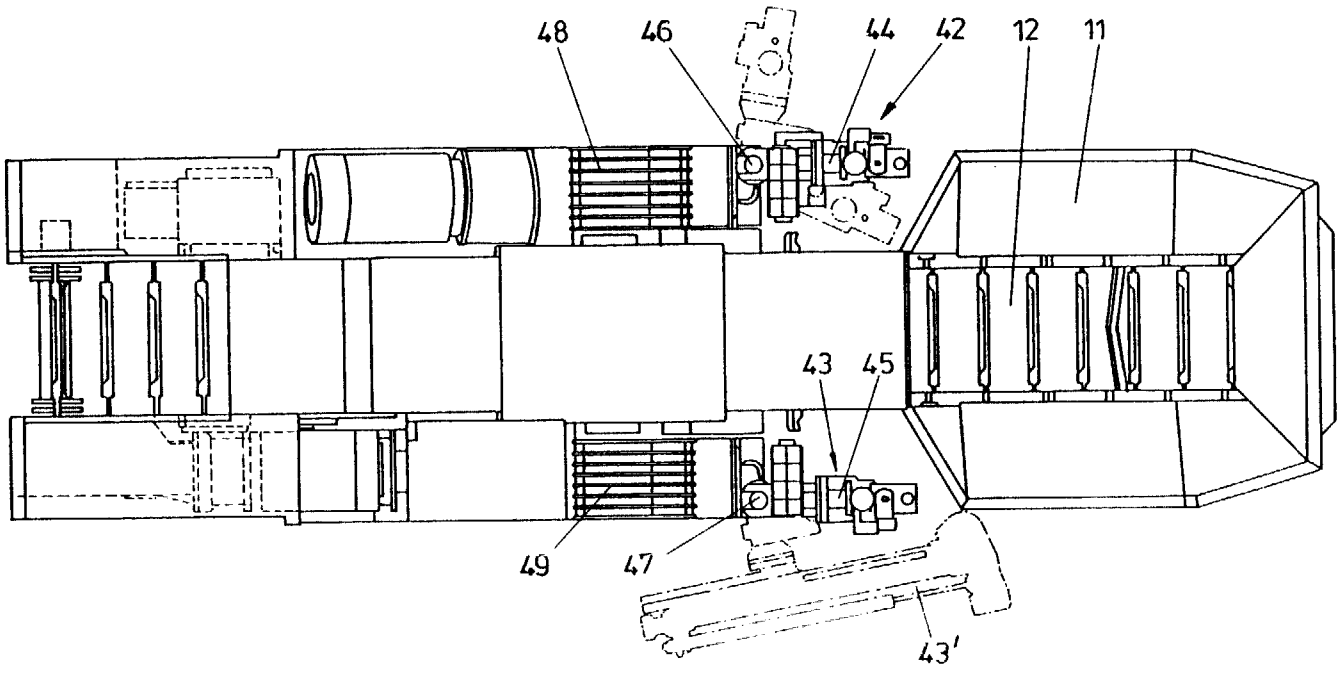

FIGS. 6 and 7 show an embodiment in which one device 42 and 43, respectively, for boring anchor holes and placing anchors in position is arranged on each of both sides of the frame 41. These devices 42 and 43 for boring anchor holes and for positioning anchors are arranged on comparatively short swivel levers 44 and 45 which are supported on the frame 41 for being swivellable around vertical axes 46 and 47. The various swivelled positions are indicated by dash-dotted lines. At both sides of the armor chain conveyor 12 there are arranged on the frame 41 operator's stands 48 and 49. An individual operator can thus be associated with each of both devices 42 and 43 for boring anchor holes and placing anchors in position, so that idle periods, during which the anchor holes are made and the anchors are placed in position, are reduced to a minimum. The right-hand device 43 for boring anchor holes and positioning anchors is shown in a horizontal position 43' in which position the chassis can be moved on the caterpillars 27.

What is claimed is:

1. A movable crushing machine for use with a movable underground mining machine of the kind which includes a removal conveying device for conveying mined material from a mine face in a rearward direction away from the mine face, said crushing machine comprising: a mobile chassis supported on the mine floor; means for driving said chassis in forward and rearward travel directions; a frame pivoted to said chassis for swinging movement about an axis transverse to the travel direction at a location rearward of the longitudinal center of said frame; means for swinging said frame about said axis; a longitudinally extending conveyor carried by said frame and having a forward end for receiving mined material from a removal conveyor on a mining machine located in front of said crushing apparatus, said conveyor also having at least one crushing roll for crushing mined material and a discharge end located rearwardly of the crushing roll for transferring mined crushed material to a conveying system which removes the material from the mine, the arrangement of said conveyor on said frame being such that upon downward swinging of the forward end of said frame, the forward end of said conveyor engages and becomes supported by the mine floor and upon upward swinging of said frame, said forward end of said conveyor is raised off the mine floor to permit said crushing machine to be driven along the mine floor; and at least one device for boring anchor holes and placing anchors in the mine floor, said device being located forwardly of said transverse pivot axis of said frame and means supporting said device on said frame for forward, rearward and transverse movement relative to said frame, said means including an arm which is pivotally connected to said frame for swinging movement about a vertical axis.

2. A crushing machine as in claim 1 including an operator's stand carried by said frame at a loction adjacent the pivot connection between said frame and said arm which carries said boring device.

3. A crushing apparatus as in claim 1 wherein the vertical pivot axis for said arm is located laterally of said frame and forwardly of said crusher roll.

4. A crushing machine an in claim 1 wherein said arm is length-adjustable by means of a piston and cylinder assembly.

5. A crushing machine as in claim 1 including a receiving chute carried by said frame for guiding mined material received from a mining machine to said conveyor, said chute having a forward-rearward dimension corresponding to the magnitude of an advancing step of a mining machine.

6. A crushing machine as in claim 1 wherein said conveyor is an armor chain conveyor above which said crusher roll is located, said crusher roll having a rotation axis which is horizontal and transverse to the longitudinal direction of the armor chain conveyor.

7. A crushing machine as in claim 1 wherein said crusher roll is a roll beater crusher.

8. A crushing machine as in claim 1 wherein there is a boring device and respective arm located on said side of said conveyor.

9. A crushing machine as in claim 8 wherein said boring devices are located rearward of the forward end of said conveyor.

10. A crushing machine as in claim 8 including an operator's stand carried by said frame at a location adjacent each pivot connection between said frame and each arm.

11. Mining and crushing apparatus comprising: a mobile underground mining machine which includes a removal conveying device for conveying mined material from a mine face in a rearward direction away from the mine face; a crushing machine located behind said mining machine, said crushing machine including a mobile chassis supported on the mine floor, means for driving said chassis in forward and rearward travel directions, a frame pivoted to said chassis for swinging movement about an axis transverse to the travel direction at a location rearward of the longitudinal center of said frame, means for swinging said frame about said axis, a longitudinally extending conveyor carried by said frame and having a forward end receiving mined material from said removal conveying device of said mining machine, said conveyor also having at least one crushing roll for crushing mined material and a discharge end located rearwardly of the crushing roll, the arrangement of said conveyor on said frame being such that upon downward swinging of the forward end of said frame, the forward end of said conveyor engages and becomes supported by the mine floor and upon upward swinging of said frame, said forward end of said conveyor is raised off the mine floor to permit said crushing machine to be driven along the mine floor, and at least one device for boring anchor holes and placing anchors in the mine roof, said device being located forwardly of said transverse pivot axis of said frame and means supporting said device on said frame for forward, rearward and transverse movement relative to said frame; and a conveyor system located behind said crushing machine for receiving mined, crushed material from said discharge end of said conveyor on said crushing machine.

12. Apparatus as in claim 11 wherein said conveyor system includes a plurality of conveyor devices arranged in sequence in the travel direction, and means for coupling said crushing machine to the conveyor device which is closest to said crushing machine.

13. Apparatus as in claim 11 wherein said mining machine advances in a forward direction in steps, said crushing machine including a receiving chute carried by said frame of said crushing machine for guiding mined material received from said removal conveyor device on said mining machine to said conveyor, said chute having a forward-rearward dimension corresponding to the magnitude of an advancing step of said mining machine.

14. Apparatus as in claim 11 wherein said conveying device on said mining machine is mounted on said mining machine for swinging movement about a vertical axis.

* * * * *